United States Patent [19]

Wildridge

[11] 4,007,690

[45] Feb. 15, 1977

[54] PRACTICE BOMB SIGNAL FOR DAY OR NIGHT OPERATION

[75] Inventor: John E. Wildridge, Washington, Ind.

[73] Assignee: The United States of America as represented by the Secretary of the Navy, Washington, D.C.

[22] Filed: Nov. 21, 1975

[21] Appl. No.: 634,212

[52] U.S. Cl. ..... 102/87; 102/6; 102/32; 102/60; 102/66; 102/90

[51] Int. Cl.[2] ..... F42B 11/16

[58] Field of Search ..... 102/6, 7.6, 65, 66, 102/87, 90, 32, 37.6, 39, 31; 149/37, 84

[56] References Cited

UNITED STATES PATENTS

| | | | |
|---|---|---|---|
| 1,754,987 | 4/1930 | Driggs, Jr. et al. | 102/52 |
| 2,316,172 | 4/1943 | Kowalski | 102/87 |
| 2,545,275 | 3/1951 | Griffith | 102/37.8 X |
| 3,211,098 | 10/1965 | Stadler et al. | 102/87 |
| 3,298,311 | 1/1967 | Catlin | 102/90 |
| 3,361,066 | 1/1968 | Gawlick et al. | 102/87 |
| 3,473,472 | 10/1969 | Bliss et al. | 102/87 X |
| 3,635,162 | 1/1972 | Lohkamp et al. | 102/4 |
| 3,724,385 | 3/1973 | Beatty et al. | 102/81 |
| 3,738,278 | 6/1973 | Bachusky et al. | 102/90 |
| 3,810,426 | 5/1974 | Baker | 102/87 |

OTHER PUBLICATIONS

De Ment, "Fluorescent and Carcinogenic Smoke-Producing Compositions," Published Mar. 10, 1953, vol. 668, pp. 540–541.

*Primary Examiner*—Harold Tudor
*Attorney, Agent, or Firm*—R. S. Sciascia; Paul S. Collignon

[57] ABSTRACT

A signal cartridge for displaying the location of a practice bomb during day or night operation. Upon detonation of the signal cartridge, a power charge expels both a chemical payload and a flashcube from the cartridge case. The flashcube is activated outside the cartridge case. The chemical payload, which is air/water reactive, forms a cloud which is visible during daylight. At night, the light produced by the flashcube is scattered and reflected by particles in the cloud to provide a display.

4 Claims, 5 Drawing Figures

PRACTICE BOMB SIGNAL FOR DAY OR NIGHT OPERATION

BACKGROUND OF THE INVENTION

The invention relates to practice bomb cartridges and more particularly to a practice bomb cartridge which will not start fires when detonated in grass or woods during the dry months.

Various types of signal cartridges are used in practice bombs which are launched from aircraft to indicate the point of bomb impact. The cartridge is fitted into the signal cavity of the practice bomb and, when the bomb is dropped, impact forces a firing pin against the signal primer, and ignites an expelling charge. The expelling charge, which is usually smokeless powder, ignites and expels a phosphorus composition, such as red phosphorus, to produce a flash of light and a puff of white smoke. While signal cartridges containing phosphorus provide, upon detonation, an excellent signal, these cartridges have the disadvantage in that the burning of the phosphorus composition start fires and therefore the cost of fire protection services and damage claims are significantly high.

In order to reduce the danger of fires, one military cartridge case is filled with an inert material, such as zinc oxide powder. Upon detonation, the expelling charge expels a cloud of zinc oxide powder. This cloud, however, is not visible at night and the use of an inert material such as zinc oxide is limited to daytime operation.

In U.S. Pat. No. 3,810,426, entitled "Gun Launched Training Projectile", which issued May 14, 1974, to Alan C. Baker, there is disclosed a marking projectile which has a flashcube mounted in the body. Upon impact of the projectile, a hammer drives actuating fingers into the base of the flashcube to fire the flashlamps and provide an impact signal.

SUMMARY OF THE INVENTION

The present invention relates to a signal cartridge for displaying the location of a practice bomb during day or night operation and, more particularly, relates to a signal cartridge which, when fired, is not likely to start grass or forest fires.

An expelling charge is provided in a cartridge case near a primer, and a flashcube and chemical payload are positioned within the cartridge case and are expelled upon ignition of the expelling charge. A firing device is provided adjacent the flashcube, however, a bore rider device is provided which prevents flashing of the flashcube until the flashcube extends outside the cartridge. During daylight, the ejection of the chemical payload forms a cloud which is visible. During night operations, the flashcube provides light which is scattered and reflected by the particles in the cloud to provide a display.

It is therefore a general object of the present invention to provide a signal cartridge which can be used during either day or night operations to provide a signal for locating a practice bomb.

Another object of the present invention is to provide a signal cartridge which is safe to use in grassy and wooded areas and which will not start fires.

Other objects, advantages and novel features of the present invention will become apparent from the following detailed description of the invention when considered in conjunction with the accompanying drawing.

DESCRIPTION OF THE PREFERRED EMBODIMENTS

Figure 1:
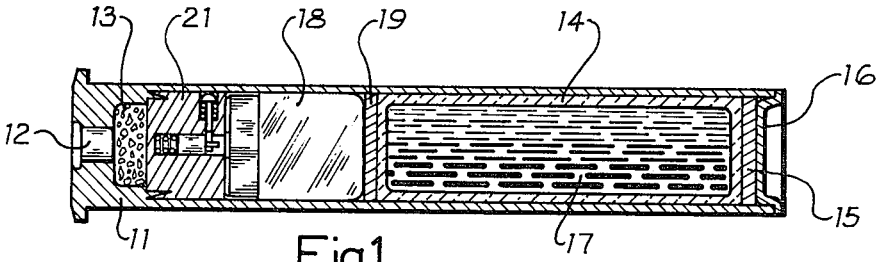
FIG. 1 is a longitudinal sectional view of a preferred embodiment of the present invention.

Referring now to the drawing, there is shown in FIG. 1, a cartridge case 11 having a primer 12 in one end and arranged to be detonated when struck by the tang of a firing pin. An expelling charge 13, such as a quantity of either black or smokeless powder, is positioned near primer 12 and firing of primer 12 will cause ignition of expelling charge 13. An ampoule 14 of frangible material is placed within cartridge case 11 near the forward end which is closed with a spacer 15 and an end cap 16. The frangible ampoule 14 is filled with a chemical payload 17 such as an air/water reactive material which, when dispersed will provide a cloud visible in daylight. By way of example, titanium tetrachloride ($T_iCl_4$) has successfully been dispersed to provide a visible cloud and also a mixture comprised of fifty percent titanium tetrachloride and fifty percent vanadium oxytrichloride has been used.

A flashcube 18 is positioned within cartridge case 11 and is separated from frangible ampoule 14 by a spacer 19. Flashcube 18 is commercially available and is of the type that can flash without batteries. The flashcube is provided with a percussive primer in its base which fires the lamp when struck by a tensioned spring. Each lamp has its own spring which is held under tension by a tiny retaining pin. When the spring is lifted over the retaining pin, the freed spring immediately snaps sharply against the flashcube's metal tube to fire the primer. The primer sparks fly upward and ignite zirconium foil within the lamp to provide a bright flash.

Figure 4:
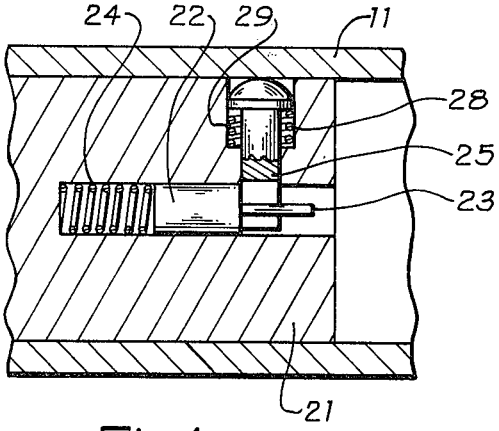
FIG. 4 is a partial sectional view showing a bore rider pin arrangement.
Figure 5:
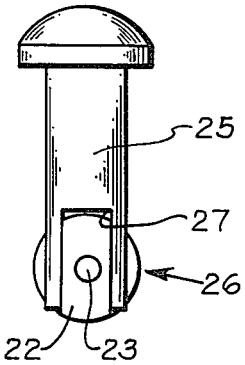
FIG. 5 is a side view of a bore rider pin.

As best shown in FIG. 4 of the drawings, an initiator 21 is closely fitted in cartridge case 11 an is provided with a firing pin 22 having a tang 23 which is designed to release the spring in the base of flashcube 18. A spring 24 is provided to supply the necessary force to move firing pin 22 against flashcube 18, however, a bore rider pin 25 prevents firing pin 22 from being actuated until flashcube 18 is outside cartridge case 11. Bore rider pin 25 is provided with a flat portion 26 which has a slot 27 therein which is greater in width than the diameter of tang 23 but less in width than the diameter of pin 22. A spring 28 is provided in bore 29 of initiator 21 and, when bore rider pin 25 clears cartridge case 11, spring 28 causes bore rider pin 25 to be ejected thereby releasing firing pin 22.

OPERATION

By way of example, the signal cartridge of the present invention might be used in a practice bomb of the type shown in U.S. Pat. No. 3,635,162, which issued Jan. 18, 1972, to Carl W. Lohkamp and James E. Short, Jr. In this practice bomb, the signal cartridge is loosely fitted in the bore of the practice bomb and, upon impact of the bomb with the ground, or some target, the momentum of the signal cartridge causes the primer to strike a firing pin.

Figure 2:
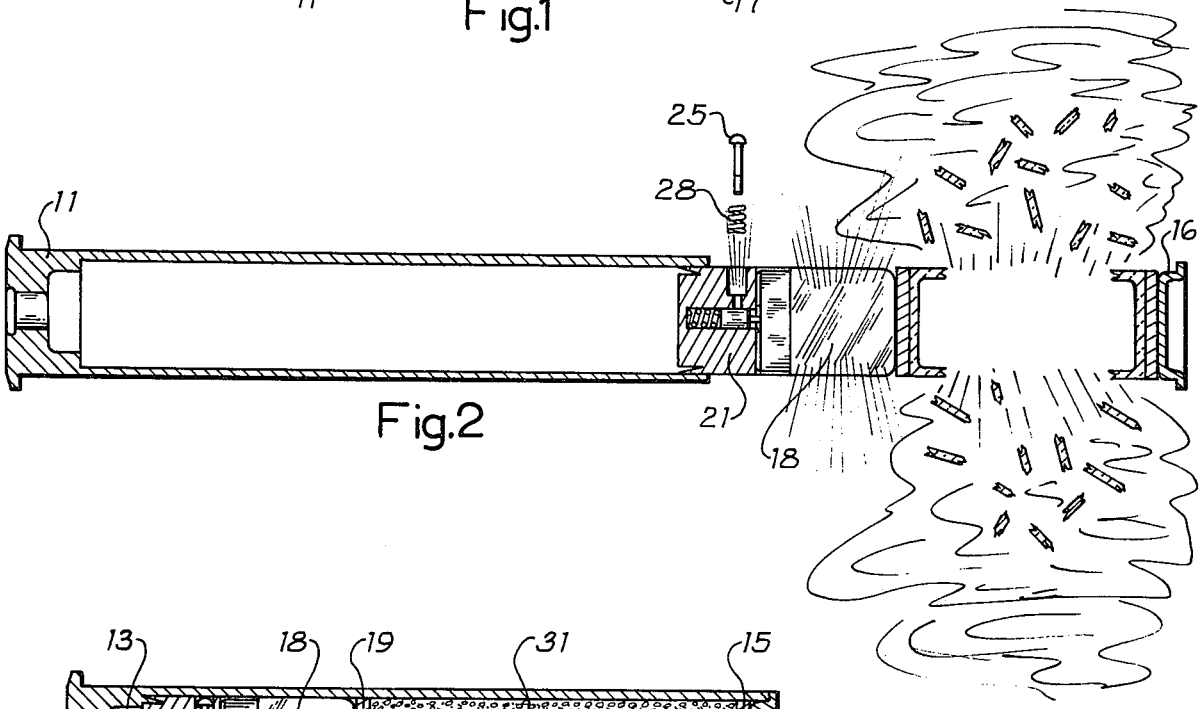
FIG. 2 is a sectional view showing the invention being fired.

Detonation of primer 12 causes ignition of expelling charge 13 which blows off end cap 16 and discharges the items inside cartridge case 11. As shown in FIG. 2 of the drawing, the pressure build-up inside cartridge case 11 causes ampoule 14 to break thereby dispersing the chemical payload 17. The chemical payload, such as a quantity of titanium tetrachloride, reacts with the air, and the moisture in the air, to provide a cloud thereby providing a signal which is visual and indicates the point of impact of the practice bomb.

As initiator 21 moves along the cartridge case 11 bore rider pin 25 prevents firing pin 22 from actuating flashcube 18 and bore rider pin 25 is prevented from moving by the inside of cartridge. When bore rider pin 25 passes the end of cartridge case 11, spring 28 ejects bore rider pin 25 and spring 24 moves firing pin 22 so that tang 23 will trigger flashcube 18. It can be seen that flashcube 18 is, at the time of flashing, outside of cartridge case, and the light is scattered and reflected by the particles of the cloud to provide a display for night exercises.

Figure 3:
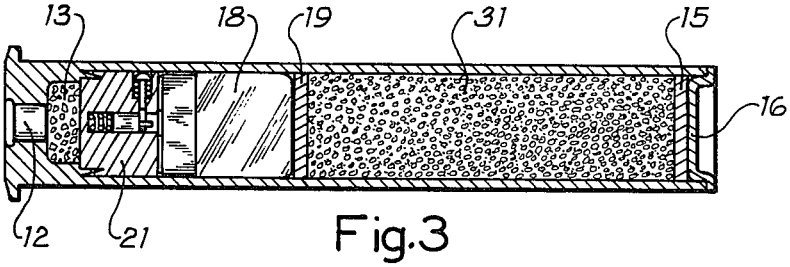
FIG. 3 is a sectional view, similar to FIG. 1, of another embodiment.

Referring now to FIG. 3 of the drawings, there is shown another embodiment wherein the frangible ampoule is eliminated and a quantity of display material 31 is placed directly in cartridge case 11. By way of example, the display material might be a fluorescent dye, glitter material, ground glass or other inert material. In feasibility tests conducted at the Naval Weapons Support Center, Crane, Indiana, high-temperature fluorescent dyes produced brillant clouds of yellow, green, red, and orange which were distinguishable from a one mile observation point. High temperature fluorescent dyes are commercially available and can be obtained from the Hercules, Inc., Wilmington, Del. 19899 (Radiant Fluorescent Pigments) or from the Day-glo Color Corp., Cleveland, Ohio, 44103 (Day-glo Pigments).

It can thus be seen that the present invention provides a cartridge signal which, when detonated, can provide a day or night display. As detonation of the cartridge signal does not produce heat or flame, the initiation of fires in grass or wooded areas has been eliminated.

Obviously many modifications and variations of the present invention are possible in the light of the above teachings. It is therefore to be understood that within the scope of the appended claims the invention may be practiced otherwise than as specifically described.

I claim:

1. A signal cartridge for use in a practice bomb for indicating a point of impact comprising, a cartridge case, a primer in said cartridge case arranged to be detonated by a first firing pin, an expelling charge adjacent said primer, a quantity of marking material within said cartridge case for forming a signal cloud upon discharge from said cartridge case by said expelling charge, a percussively-ignitable flashcube within said cartridge case, and means for flashing said flashcube after said flashcube is expelled from said cartridge case, said means including a second firing pin engageable with said flashcube and a bore rider pin for preventing actuation of said second firing pin until said bore rider pin passes the end of said cartridge case.

2. A signal cartridge for use in a practice bomb for indicating a point of impact as set forth in claim 1 wherein said quantity of marking material is an air/water reactive material and is contained in a sealed frangible container within said cartridge case.

3. A signal cartridge for use in a practice bomb for indicating a point of impact as set forth in claim 2 wherein said air/water reactive material is titanium tetrachloride.

4. A signal cartridge for use in a practice bomb for indicating a point of impact as set forth in claim 2 wherein said air/water reactive material is a mixture of equal parts of titanium tetrachloride and vanadium oxytrichloride.

* * * * *